United States Patent [19]

Thygesen et al.

[11] Patent Number: 4,766,617

[45] Date of Patent: Aug. 30, 1988

[54] DISPOSABLE SANITARY TOILET SEAT COVER

[76] Inventors: Eskild G. Thygesen, Broholmvej 14, Tulstrup, DK-7430 Ikast; Bente Merrild, SindinggÅrdvej 21, Sinding, DK-7400 Herning, both of Denmark

[21] Appl. No.: 33,655

[22] Filed: Apr. 3, 1987

Related U.S. Application Data

[63] Continuation of PCT DK86/00087 filed Aug. 11, 1986, published as WO87/01022 on Feb. 26, 1987.

[30] Foreign Application Priority Data

Aug. 12, 1985 [DK] Denmark ..... 3656/85

[51] Int. Cl.[4] ..... A47K 13/14

[52] U.S. Cl. ..... 4/243; 4/242; 4/247

[58] Field of Search ..... 4/242–246

[56] References Cited

U.S. PATENT DOCUMENTS

| | | | |
|---|---|---|---|
| 1,440,773 | 1/1923 | Dykstra | 4/243 |
| 2,025,941 | 12/1935 | Dunnell | 4/243 |
| 3,851,341 | 12/1974 | Aoyama | 4/243 |
| 4,050,105 | 9/1977 | Marceaux | 4/242 X |
| 4,264,992 | 5/1981 | Tromp | 4/242 X |

FOREIGN PATENT DOCUMENTS

| | | | |
|---|---|---|---|
| 914181 | 6/1954 | Fed. Rep. of Germany . | |
| 2209195 | 9/1973 | Fed. Rep. of Germany . | |
| 2425782 | 12/1975 | Fed. Rep. of Germany | 4/243 |
| 2527214 | 12/1976 | Fed. Rep. of Germany . | |
| 2637327 | 2/1978 | Fed. Rep. of Germany . | |
| 2714586 | 10/1978 | Fed. Rep. of Germany | 4/242 |
| 2656496 | 11/1978 | Fed. Rep. of Germany | 4/242 |
| 3305265 | 8/1984 | Fed. Rep. of Germany | 4/243 |
| 983702 | 6/1951 | France . | |
| 2421588 | 12/1979 | France | 4/242 |
| 63362 | 11/1926 | Sweden . | |
| 588250 | 5/1977 | Switzerland . | |
| 22483 | 1/1892 | United Kingdom . | |
| 2097832 | 11/1982 | United Kingdom . | |

*Primary Examiner*—Henry K. Artis

*Attorney, Agent, or Firm*—Watson, Cole, Grindle & Watson

[57] ABSTRACT

A disposable sanitary toilet seat cover of the type capable of being flushed in the toilet and comprising a foil or paper sheet provided with a round-going weakening line dividing the cover into a central field and an annular field, the latter serving to protect the user from contact with the toilet seat. The toilet seat cover can be handled with particular ease and speed if the annular field is fixed to the toilet seat by means of a pressure adhesive, and in order to achieve safe protection against the transfer of contagious matter from the toilet bowl the central field is constructed with an additional weakening line which divides the central field into two field portions, one of which can depend into the toilet bowl, while the other field portion can be used as toilet paper.

4 Claims, 1 Drawing Sheet

DISPOSABLE SANITARY TOILET SEAT COVER

CROSS REFERENCE TO RELATED APPLICATION

This application is a continuation application of PCT/DK86/00087, filed 11 Aug. 1986, published as W087/01022 on Feb. 26, 1987, which in turn was based on Danish Application No. 3656/85, filed Aug. 12, 1985. Priority from the noted PCT application is requested under U.S.C. 120 and 365(c), and priority from the noted Danish application is requested under 35 U.S.C. 119 and 365(b).

BACKGROUND OF THE INVENTION

This invention relates to a disposable sanitary toilet seat cover of the type capable of being flushed in the toilet and comprising a foil or paper sheet provided with a round-going weakening line dividing the cover into a central field and an annular field, the latter serving to protect the user from contact with the toilet seat, the cover being fixable in relation to the toilet seat by means of a pressure adhesive.

Several types of covers for toilet seats are known which are intended to protect the user against the transfer of contagious matter that may be present on the toilet seat. An example of such cover is shown, e.g., in DE No. 2,209,195 and DE No. 2,714,586. Such a cover has a shape and extension such as to be capable of overlying and covering a conventional toilet seat, and is usually intended for use once only and subsequent disposal either by flushing or by deposition in sanitary containers. The known cover sheets or cover strips are frequently made from a relatively stiff material to facilitate the fixation of the sheet on the toilet seat. Such cover sheets or strips are as a rule disposed of by deposition in sanitary containers. Moreover, from DE No. 914,181 such cover is known which provides a protective ring and which is fixed by means of an adhesive.

Alternatively, such cover sheets or cover strips such as those disclosed in U.S. Pat. No. 4,050,105 are constructed with marginal zones adapted to be folded around the edge of the seat, or with means intended to be engaged with the toilet seat and/or the toilet bowl in one way or another to obtain fixation of the cover. Such covers are shown, e.g., in NO No. 48,638 and GB No. 2,097,832. The sheets disclosed in these publications either permit engagement with the toilet seat and/or the toilet bowl or, alternatively, an inner part of the sheet is totally removed to lay open the toilet for use. Therefore, it can in many cases be a relatively cumbersome procedure to fix covers or strips which ensure a safe protection of the user, especially if this cover sheet consists of a relatively soft material suitable for being flushed in the toilet after use.

SUMMARY OF THE INVENTION

It is the object of the invention to remedy the above mentioned drawbacks and to provide a cover which, when folded, can be carried along by the user and which presents itself as a disposable paper or foil cover, which can easily be placed on and fixed to a toilet seat, and which does not only protect the user against direct contact with the toilet seat, but also gives protection against contact with the inner side of the toilet bowl, and at the same time comprises a portion that can be used as toilet paper, the cover also being suitable for use by a cleaning staff to "seal" toilets after cleaning.

With this object in view the disposable sanitary toilet seat cover according to the invention is characterized in that the central field is provided with at least one weakening line dividing it into at least a first and a second field portion, one of which can depend into the toilet bowl, while another field portion can be used as toilet paper. Such a cover can easily be applied to and fixed to the toilet seat by the user. If the cover is used by a female user, the whole of the central field is torn off so that only the annular field remains and covers the toilet seat as such, and the opening produced by the tearing off makes it possible to use the toilet. When the cover is used by a male user, only the second field portion of the central field is torn off, and the first field portion is bent into the toilet bowl, whereby it will protect the user against the transfer of contagious matter by contact with the inner side of the bowl. In both situations of use, the central field or the second field portion may be employed as toilet paper, and after use the cover in its entirety can be flushed away.

Thus, the cover according to the invention can be converted into a protective sheet, which in use gives the user an efficient protection against the transfer of contagious matter. Moreover, when the central field is not wholly or partly torn off, the cover can be used as a totally covering protective sheet. In this state it can also be used, e.g., by the cleaning staff in hotels or the like, which after cleaning applies the cover to the toilet seat and omits to remove the central field so that a subsequent user has the certainty that the toilet has not been used after cleaning.

When folded, covers according to the invention can be sold in vending machines or in packages containing a suitable number of covers for travel or the like purposes.

In summary, it can be said that with a cover according to the present invention a combination of several provided advantages is obtained, as the cover, which can easily be fixed to the toilet seat by means of a pressure adhesive, by means of the at least one weakening line provides a very hygienic product, which when used by a male user protects against both contact with the seat surface and the inner side of the toilet bowl, and when used by a female user provides the necessary protection against contact with the surface of the toilet seat, as the female user will be able to use the entire central field as toilet paper. The special design of the cover sheet with weakening lines in combination with the adhesive will furthermore render it possible to use the cover sheet to seal toilets after cleaning, which sealing offers the above-mentioned advantages to the next user at the same time as the user can be sure that the toilet has not been used after the cleaning.

In a preferred embodiment of the invention, the sheet is more easily tearable along the additional weakening line or lines than along the round-going weakening line. Thereby the advantage is obtained that when the user tears off the central field, this will always start with a partial tearing off of the central field, because the first field portion, which is intended to depend into the toilet bowl, will remain connected with the annular field. Thereafter the first field portion can be torn off, if the cover is to be used by a female user.

In a further embodiment, the cover advantageously may be provided with a pressure adhesive of a type not requiring the use of a protecting strip. Hereby the application and fixation of the cover becomes particularly quick and simple, because the user does not have to remove protection strips from the rear side of the cover before applying it to the toilet seat.

DESCRIPTION OF THE PREFERRED EMBODIMENT

Figure 1:
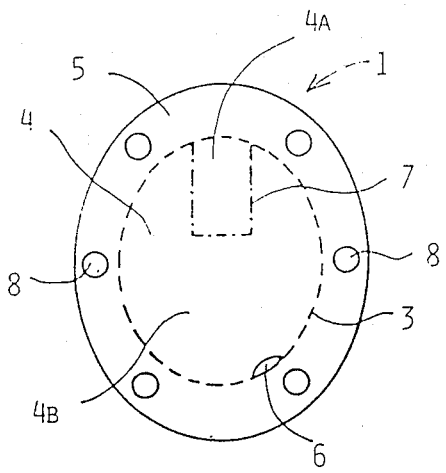
FIG. 1 is a plan view of a disposable sanitary toilet seat cover according to an embodiment of the invention, and FIG. 2 a part-section through a toilet bowl with seat, to which a cover according to FIG. 1 has been applied.
Figure 2:
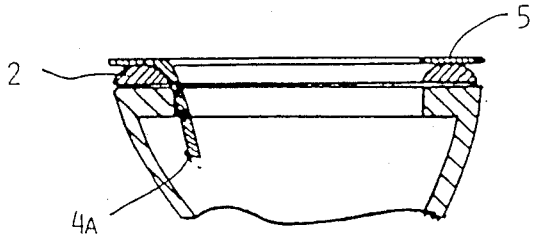

FIG. 1 shows a disposable sanitary toilet seat cover in the form of an elongated (essentially oval) paper sheet 1, which has an extension substantially matching with the outer contour of a conventional toilet seat 2. The cover is seen from the side, which in use is applied to the toilet seat. The paper used for the cover is of a type suitable for flushing after use so that all parts of the paper sheet can be disposed of in the toilet.

The paper sheet 1 is provided with a weakening line 3 which divides the sheet 1 into a central field 4 and an annular field 5. Moreover, the sheet has a finger hole 6, which can be used for gripping in the process of tearing off the whole of the central field or a porton 4B thereof. A further weakening line 7 divides the central field into at least two field portions, one of which 4A can depend into the toilet bowl, while the other field portion 4B can be used as toilet paper. In the embodiment shown the weakening line 7 provides the field portion 4A with a generally rectangular shape. The field portion 4A is centered on an imaginary central axis which extends through the sheet 1 in its elongated dimension.

The annular field 5, which is intended to be applied to a toilet seat, has an extension corresponding to that of a conventional toilet seat. The annular field 5 will therefore protect the user against any contagious matter on the toilet seat. The paper sheet 1 is fixed easily and quickly to the toilet seat by means of pressure adhesive 8 placed on the underside of the paper sheet. This pressure adhesive 8 is in the embodiment illustrated provided in six spots, but any number of spots can be used or the pressure adhesive may be provided in an annular zone along the whole of the annular field 5. The adhesive is of the type not requiring the use of a protective strip and not leaving adhesive residues on the toilet seat. By using such an adhesive the paper sheet 1 can be applied to the toilet seat 2 very conveniently and quickly. Such an adhesive is, e.g., known from POST-IT ® labels.

When the sheet is used by a female user, the whole of the central field 4 is torn off, whereas a male user will allow the field portion 4A to remain attached to the annular field 5 so that it protects against contact with the inner side of the toilet bowl. The weakening lines 3 and 7 are so arranged that the sheet can more easily be torn off along the line 3 than along the line 7. The field portion 4A will thus normally remain attached to the annular field 5 and must then be torn off separately when desired.

What is claimed is:

1. In a disposable sanitary toilet seat cover which can be flushed away in the toilet, said toilet seat cover consisting of an elongated sheet made of foil or paper, said elongated sheet including a first endless weakening line therein that divides the elongated sheet into a central part and an outer annular part, and a plurality of spaced-apart adhesive means on one surface of said annular part for attaching the annular part to a toilet seat, the improvement wherein a second weakening line extends from said first weakening line into said central part and back to said first weakening line, thereby dividing said central part into a first field portion defined within the second weakening line and a second field portion defined outside said second weakening line and within said first weakening line, said first and second field portions being separately removable from within said annular part such that one or both of said first and second field portions can be used as toilet paper, wherein said second weakening line connects said first field portion with said second field portion less strongly than said first weakening line connects said first field portion and said second field portion to said outer annular part, and wherein said second field portion includes a finger hole to enable it to be manually detached from both said outer annular part and said first field portion, thereby leaving said first field portion attached to said annular part.

2. The disposable sanitary toilet seat cover according to claim 1, wherein said second weakening line provides said first field portion with a generally rectangular configuration.

3. The disposable sanitary toilet seat cover according to claim 2, wherein said elongated sheet defines a central axis in its elongated dimension and wherein said first field portion is centered on said central axis.

4. The disposable sanitary toilet seat cover according to claim 1, wherein said elongated sheet is generally oval and wherein said first weakening line is generally oval.

* * * * *